United States Patent [19]

Nakamura et al.

[11] 4,299,560

[45] Nov. 10, 1981

[54] COMBUSTION CONTROL SYSTEM FOR BURNING INSTALLATION WITH CALCINING BURNER

[75] Inventors: Norio Nakamura, Omiya; Satoshi Tominaga, Tokyo; Takashi Kawata, Chiba, all of Japan

[73] Assignee: Ishikawajima-Harima Jukogyo Kabushiki Kaisha, Tokyo, Japan

[21] Appl. No.: 84,887

[22] Filed: Oct. 15, 1979

[30] Foreign Application Priority Data

Apr. 24, 1979 [JP] Japan ..... 54-50430

[51] Int. Cl.[3] ..... F27B 1/26; F27B 15/00

[52] U.S. Cl. ..... 432/36; 432/58; 432/106

[58] Field of Search ..... 432/14, 36, 58, 106; 106/100

[56] References Cited

U.S. PATENT DOCUMENTS 4,071,310 1/1978 Ghestem ..... 432/14

4,077,763 3/1978 Jager et al. ..... 432/14

OTHER PUBLICATIONS

British Patent Application No. 15369/63, F. I. Smidth & Co. A/S for "A Method of and an Installation for Treating Cement Raw Slurry".

*Primary Examiner*—John J. Camby

*Attorney, Agent, or Firm*—Alfred E. Miller

[57] ABSTRACT

A combustion control system for a rotary kiln with a suspension preheater including a calcining burner wherein slurries of Portland cement raw materials, lime slurries, alumina, magnesia or the like are filtered into a cake, the cake being burned in the kiln with the suspension preheater.

9 Claims, 3 Drawing Figures

COMBUSTION CONTROL SYSTEM FOR BURNING INSTALLATION WITH CALCINING BURNER

BACKGROUND OF THE INVENTION

The present invention relates to a combustion control system for a burning installation with a calcining burner.

The combination of a wet process for preparing raw materials and a dry process clinker burning system is known and used to attain a high thermal efficiency and high productivity in the production of cement. That is, slurries are filtered by a cake filter into cake, which in turn is burned in a rotary kiln with a suspension preheater, including a calcinator into cement clinker.

However, the conventional cement manufacturing process of the type described above, the control of the combustion in a calcinator is not effected at all, so that the improvement of thermal efficiency and the increase in production capacity cannot be attained.

In view of the above, the present invention provides a system for automatically controlling the combustion rate in a calcination zone, in which a calcining burner is installed, depending upon the heat value required for drying cake, thereby attaining a maximum thermal efficiency and ensuring stable operations. The present invention will become more apparent from the following description of some preferred embodiments thereof taken in conjunction with the accompanying drawings.

BRIEF DESCRIPTION OF THE DRAWINGS

The same reference numerals are used to designate similar parts in all the figures.

DETAILED DESCRIPTION OF THE PREFERRED EMBODIMENTS

Figure 1:
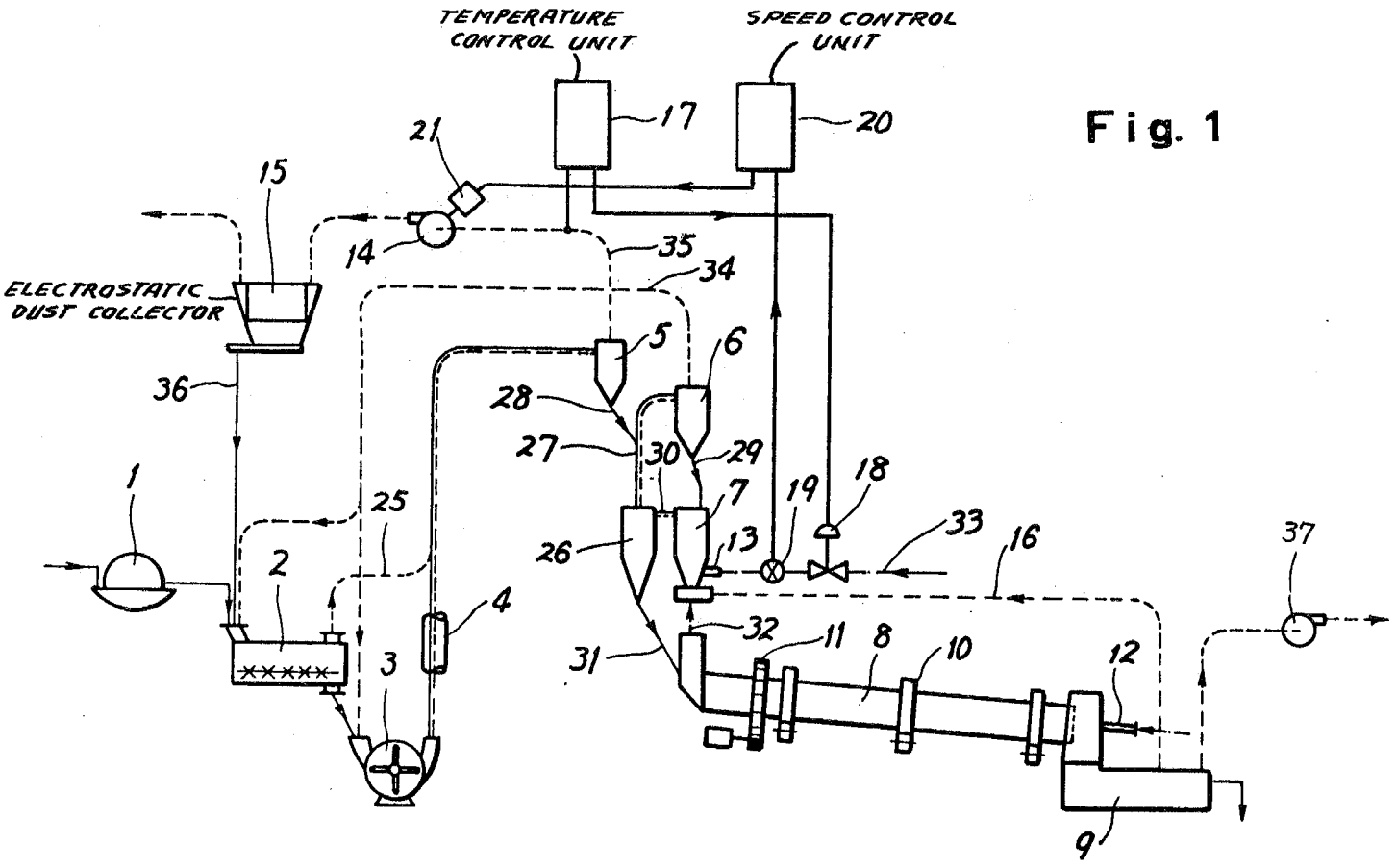
FIGS. 1, 2 and 3 are diagrammatic flow charts of first, second and third embodiments of the present invention, respectively.

First Embodiment, FIG. 1

Referring to FIG. 1, the slurries are filtered by a cake filter 1 into cake which in turn is charged into a dryer 2, such as a mixer, a rapid dryer or a rotary dryer. The cake discharged from the dryer 2 is then charged into a crusher 3. The crusher 3 and a rising pipe 4 having its lower end connected to the discharge port of the crusher 3, which constitutes a drying unit. The rising pipe 4 has its upper end connected to a cyclone 5 which is also connected through a pipe 25 to the dryer 2. A suspension preheater consists of a plurality of cyclones 6 and 26 (only two of which are shown) interconnected through a gas pipe 27 which is disposed at the downstream of the cyclone 5. The discharge or lower end of the cyclone 5 is connected through a chute 28 to the pipe 27 almost at a midpoint between the ends thereof. A chute 29 extending from the discharge or lower end of the cyclone 6 and a gas pipe 30 extending from the gas inlet port of the cyclone 26 are connected to a calcinator 7 having a calcining burner 13. The discharge port or the lower end of the cyclone 26 is connected through a feed chute 31 to a rotary kiln 8 having a burner 12. The rotary kiln 8 is connected through an exhaust pipe 32 to the calcinator 7. A cooler 9 connected at the cement clinker discharge end of the rotary kiln 8 is connected through a secondary duct 16 to the calcinator 7 and to an exhaust fan 37 which discharges the excessive cooling air into the surrounding atmosphere.

The rotary kiln 8 is supported by supports 10, and is rotated by a drive 11. In general, the dry process rotary kiln 8 is constructed from a part cut off from a wet process rotary kiln.

A flow rate control valve 18 and a flow meter 19 are inserted into a fuel feed pipe 33 which feeds the fuel to the burner 13 of the calcinator 7, and are electrically connected to a temperature control unit 17 and a speed control unit 20, respectively. The gas outlet of the suspension preheater, that is, the upper end of the cyclone 6 is connected through a pipe 34 to the cake charging port of the crusher 3. The gas outlet of the cyclone 5 is connected through a pipe 35 to an electrostatic dust collector 15. An exhaust fan 14 is inserted in the pipe 35, while a driving motor 21 of the exhaust fan 14 is electrically connected to the speed control unit 20. The temperature control unit 17 is connected to the duct 35. The dust collector 15 and the dryer 2 are connected through a conveyor 36 so that the feed dust collected by the dust collector 15 may be returned to the dryer 2. When the rapid dryer or rotary dryer is used, the pipe 34 extending from the cyclone 6 is also connected to the inlet of the dryer 2.

In FIG. 1 the solid lines indicate the flow of the feed or clinker; the dotted lines, indicate gas flows; and the one-dot chain lines indicate fuel flow.

When the slurries which contain 35~40% of water are forced to pass through the cake filter 1, their water content are reduced to 17 to 20%. The cake from the filter 1 is mixed or mixed and pre-dried in the dryer 2 and is pulverized in the crusher 3 while being dried. The pulverized feed is entrained by the gas supplied through the pipe 34 from the cyclone 6 and becomes dried particles while being transported and dried in the rising pipe 4.

The dried feed particles are charged into the cyclone 5 and the trapped and collected feed particles are charged into the gas pipe 27 through the feed chute 28 and then into the cyclone 6 while being pre-heated by the gas discharged from the cyclone 26. The feed particles trapped and collected in the cyclone 6 are charged through the feed chute 29 into the calcinator 7 and calcined. The calcined feed particles are charged through the gas pipe 30 into the cyclone 26, and the feed particles trapped and collected in the cyclone 26 are charged through the feed chute 31 into the rotary kiln 8. The clinker discharged from the rotary kiln 8 is cooled in the cooler 9 and then discharged.

The gas extracted from the cooler 9 by the exhaust fan 14 is charged through the secondary duct 16 into the calcinator 7 as the secondary air for burning the fuel charged through the burner 13. The gases discharged from the rotary kiln 8 are also charged through the exhaust pipe 32 into the calcinator 7 and burned by the burner 13 to calcine the feed particles. The calcined feed particles are charged through the gas pipe 30 into the cyclone 26. The gas from the cyclone 26 is discharged into the gas pipe 27 and preheats the feed particles which are dropping into the gas pipe 27 from the feed chute 28. The gas entrains the feed particles into the cyclone 6. The gas discharged from the cyclone 6 is charged through the pipe 34 into the crusher 3 and then the rising pipe 4. Part of the gas flowing through the pipe 34 may be charged into the dryer 2 to pre-dry the cake, and the gas discharged from the dryer 2 is made to flow into the rising pipe 4.

As described hereinbefore, the gas flowing upwards through the rising pipe 4 dries the feed particles discharged from the crusher 3 and entrains them into the cyclone 5. The gas separated from the feed particles in the cyclone 5 is forced to flow through the gas pipe 35 by the exhaust fan 14 into the electrostatic dust collector 15. The feed dust trapped and collected in the dust collector 15 is returned to the dryer 2 by the conveyor 36 while the gas free from the feed dust is discharged into the surrounding atmosphere.

The water contents in the cake obtained from the cake filter 1 varies depending upon the particle sizes and types of the raw materials, the slurry temperature, the filtering capacity of the filter 1 and so on. The required heat value, which consists of a theoretical heat value plus thermal losses due to radiation, convection and so on, is in turn dependent upon the water contents of cake. Therefore, depending upon the water contents of cake, the flow rate of the fuel supplied to the burner 13 of the calcinator 7 must be controlled so as to attain optimum combustion in the calcinator 7, thereby controlling the temperature of the gases discharged from the cyclone 6, that is, the heat value of the discharged gases.

In order to achieve the foregoing, and according to the present invention, the temperature control unit 17 connected to the pipe 35 detects the temperature of the exhaust gases from the cyclone 5, which varies depending upon the water contents of cake. If the temperature detected does not coincide with a predetermined level, for example 120° C., the temperature control unit 17 transmits the signal to the flow rate control valve 18 so that the flow rate of the fuel supplied to the burner 13 may be controlled in such a manner that the temperature of the exhaust gases may be maintained at a predetermined level or range. Simultaneously, the flow rate of the fuel is measured by the flow meter 19 and the signal representative of the flow rate is transmitted to the speed control unit 20 which in turn controls the rotational speed of the motor 21 of the exhaust fan 14 in such a way that the volume of the exhaust gases discharged by the exhaust fan 14 may ensure the complete combustion of the fuel charged through the burner 13.

Thus, the quantity of the fuel burned in the calcinator 7 is controlled in response to the water contents of the cake, and the volume of the secondary air flowing through the secondary air duct 16 from the cooler 9 is so controlled as to ensure the complete combustion in the calcinator 7. Thus, a minimum heat value which is needed to completely vaporize the water in the cake may be supplied all the time, whereby a higher thermal efficiency, and stable operations may be ensured.

Figure 2:
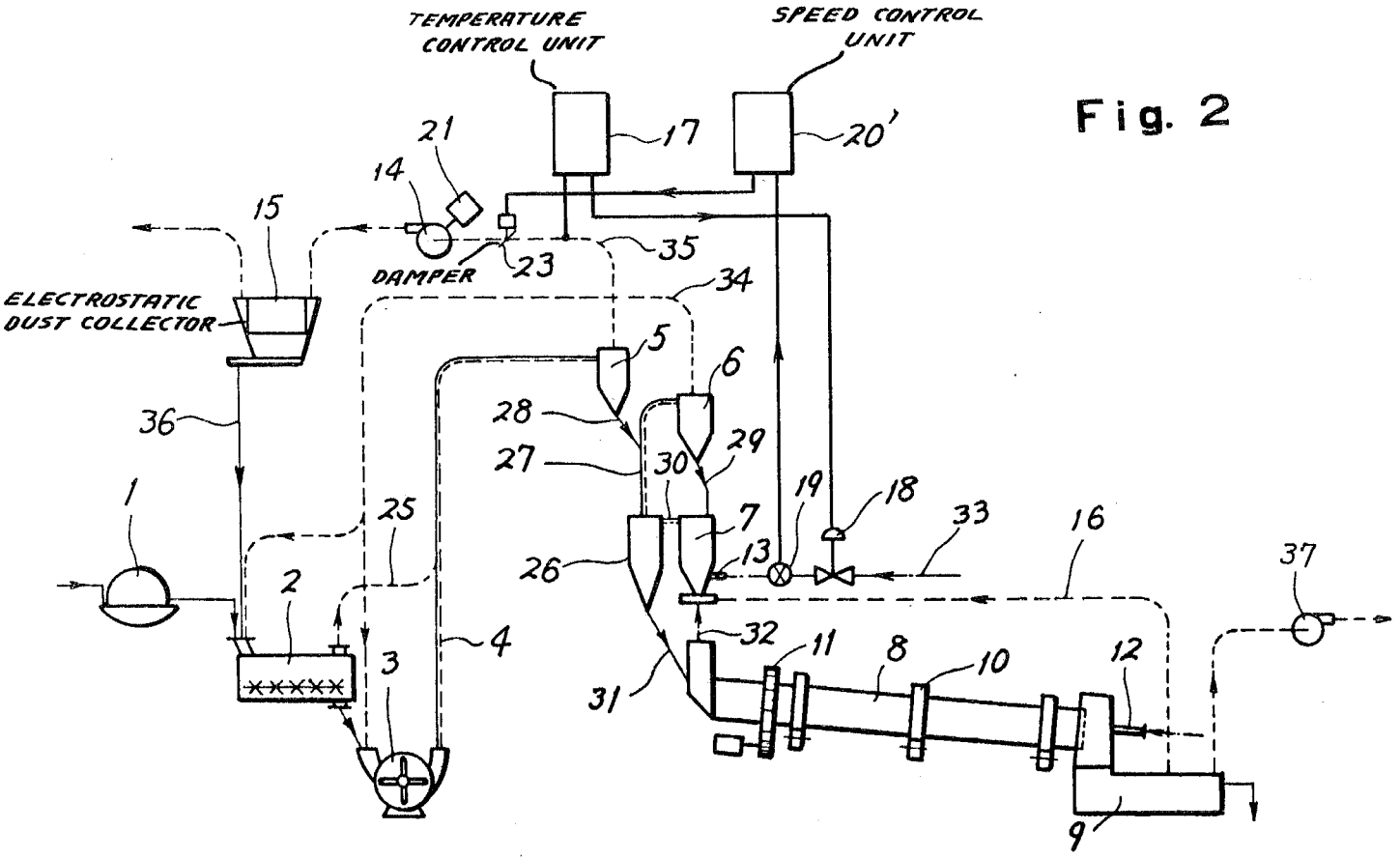

Second Embodiment, FIG. 2

FIG. 2 shows a second embodiment of the present invention which is substantially similar in construction to the first embodiment described in detail above with reference to FIG. 1 except that (a) the motor 21 of the exhaust fan 14 is driven at a constant speed and that (b) a damper 23, which is controlled by a damper control unit 20', is inserted into the gas pipe 35 so as to control the volume of the gases discharged through the exhaust fan 14. The effects, features and advantages obtainable by the second embodiment are substantially similar to those of the first embodiment.

Figure 3:
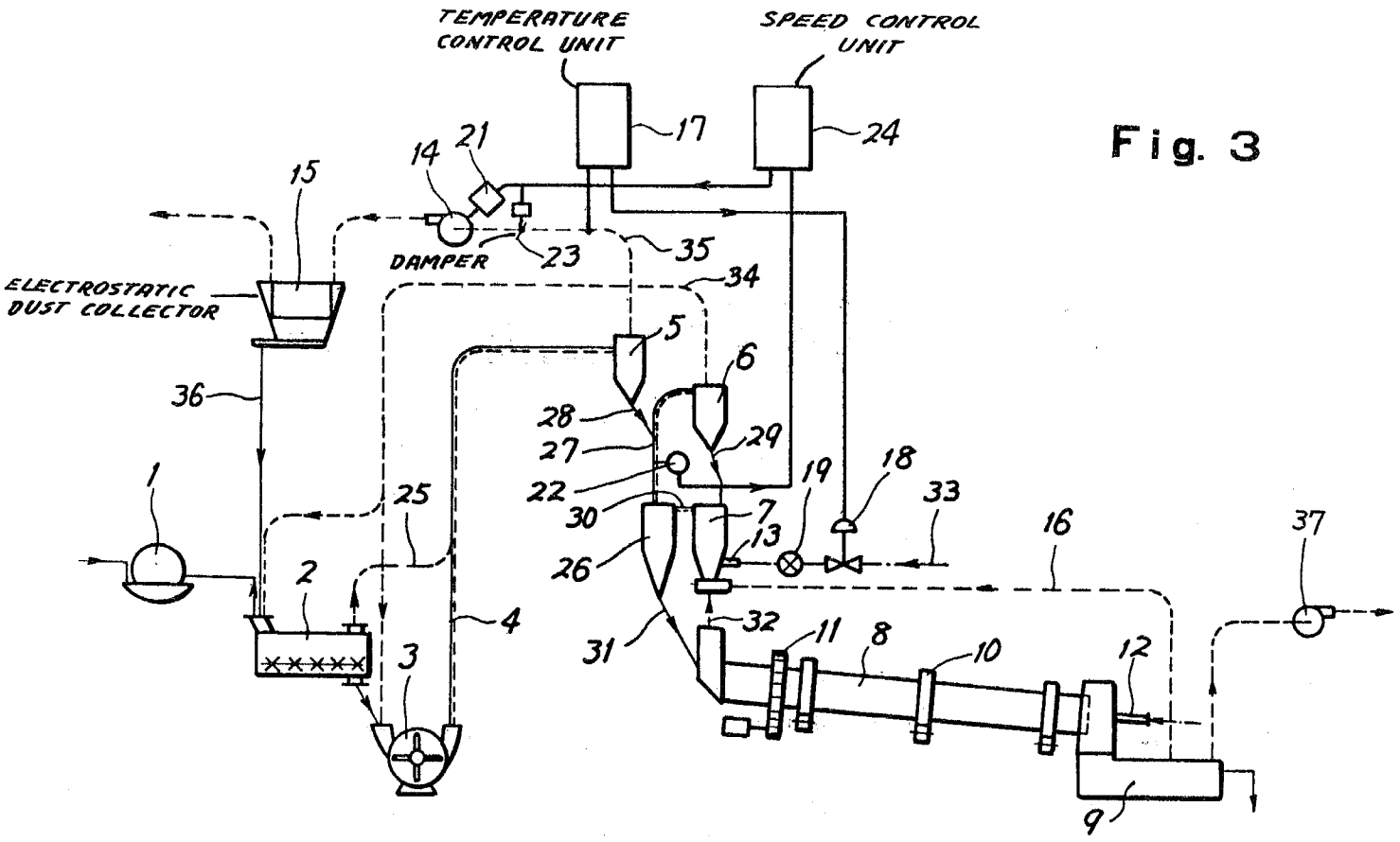

Third Embodiment, FIG. 3

FIG. 3 shows a third embodiment of the present invention which is substantially similar in construction to the first embodiment except that the motor and/or damper control unit 24 is responsive to the signal transmitted not from the flow meter 19 but from an oxygen concentration or contents analyzer 22 inserted in the pipe 27 at a point downstream of the juncture between the feed chute 28 and the pipe 27 so that the rotational speed of the motor 21 of the exhaust fan 14 and/or the opening degree of the damper 23 may be varied in such a way that the oxygen contents or concentration detected by the oxygen concentration analyzer 22 at the downstream of the calcinator 7 may be maintained, for instance at 2%. Other effects, features and advantages of the third embodiment are substantially similar to those described in conjunction with the first embodiment.

Assuming that the feed required for manufacturing one kilogram of cement clinker is 1.65 kg in dry weight, and further assuming that the water contents of the cake obtained by the cake filter 1 is 18%, then the theoretical heat value required for vaporizing the water in the cake will become 212 Kcal per kilogram of clinker. If the water contents is 20%, the heat value will become 242 Kcal.

It is to be understood that the present invention is not limited to the preferred embodiments described above with reference to FIGS. 1, 2 and 3 and that various modifications may be effected within the spirit and scope of the present invention. For instance, the exhaust pipe 32 from the rotary kiln may be directly connected to the cyclone 26 and a calcining burner may be inserted in the pipe 32. So far, the present invention has been described in conjunction with the manufacture of Portland cement, but it may be equally applied to any other processes for recovering calcium oxide from the lime slurries discharged from a craft pulp plant, or for burning alumina or magnesia.

In summary, the combustion control system in accordance with the present invention may always supply a minimum heat value needed depending upon the water contents of the cake, so that a high thermal efficiency may be attained and stable operations may be ensured. In addition, since no auxiliary heat source is employed, the combustion system is inexpensive both in construction and operating costs.

What is claimed is:

1. In a burning installation including a calcining burner of the type wherein raw material slurries are filtered into cake which in turn is dried by drying means and then pulverized into feed particles which in turn are burned by a kiln with a suspension preheater including at least one cyclone, a motor-operated fan, a calcining burner, and the gases discharged from said suspension preheater being used as a heat source for said drying means, the improvement comprising: a combustion control system having a control means wherein the quantity of fuel charged into a calcining zone is so controlled that the temperature of the exhaust gases discharged from said drying means may be maintained at a predetermined level or in a predetermined range depending upon the water contents in said cake, and said control means controlling the volume of the exhaust gases sucked by said motor-operated fan so as to correspond to the quantity of the fuel charged into said calcining zone, said control means including a temperature control unit for detecting the temperature of the exhaust gases from said cyclone and a flow rate control valve whereby if the detected temperature does not coincide with a predetermined level said temperature control unit transmits a signal to said flow rate control valve in order to change the flow rate of the fuel supplied to the burner so that the temperature of the exhaust gases are maintained at said predetermined level, a speed control unit, a flow meter for measuring the flow of the fuel and for transmitting a signal to said speed control unit for controlling the rotational speed of the motor of said motor-operated fan so that said volume of gases discharged by said motor-operated fan ensures complete combustion of the fuel charged into said burner.

2. A combustion control system as set forth in claim 1 further comprising a damper means, and wherein the volume of the exhaust gases to be discharged is controlled by controlling the degree of opening of said damper means.

3. A combustion control system as set forth in claim 2 wherein the volume of the exhaust gases to be discharged is controlled by varying the rotational speed of said motor of said exhausting means and also by controlling the degree of opening of damper means.

4. A combustion control system as set forth in claim 2 wherein the degree of opening of said damper means is varied in response to the flow rate of the fuel charged into said calcining zone.

5. A combustion control system as set forth in claim 3 wherein the rotational speed of the motor of said motor-operated fan is varied in response to the flow rate of the fuel charged into said calcining zone.

6. A combustion control system as set forth in claim 2 wherein the degree of opening of said damper means is varied in response to a concentration of oxygen downstream of said calcining zone.

7. A combustion control system as set forth in claim 3 wherein the rotational speed of the motor of said motor-operated fan and the degreer of opening of said damper means are varied in response to a concentration of oxygen downstream of said calcining zone.

8. A combustion control system as set forth in claim 1 wherein the rotational speed of said motor of said motor operated fan is varied in response to the flow rate of the fuel charged into said calcining zone.

9. A combustion control system as set forth in claim 1 wherein the rotational speed of the motor of said motor-operated fan is varied in response to a concentration of oxygen downstream of said calcining zone.

* * * * *